US009078328B2

(12) United States Patent
Anand

(10) Patent No.: US 9,078,328 B2
(45) Date of Patent: Jul. 7, 2015

(54) VEHICLE LIGHTING OUTAGE DETECTION CIRCUIT

(71) Applicant: Grote Industries, Inc., Madison, IN (US)

(72) Inventor: Nakul Anand, Madison, IN (US)

(73) Assignee: Grote Industries, Inc., Madison, IN (US)

( * ) Notice: Subject to any disclaimer, the term of this patent is extended or adjusted under 35 U.S.C. 154(b) by 313 days.

(21) Appl. No.: 13/827,592

(22) Filed: Mar. 14, 2013

(65) Prior Publication Data

US 2014/0265839 A1 Sep. 18, 2014

(51) Int. Cl.
*H05B 33/08* (2006.01)

(52) U.S. Cl.
CPC ..... *H05B 33/0881* (2013.01); *H05B 33/0827* (2013.01); *H05B 33/0893* (2013.01)

(58) Field of Classification Search
USPC ..... 315/77, 130–132, 135, 136, 192; 324/410, 762.01, 762.07
See application file for complete search history.

(56) References Cited

U.S. PATENT DOCUMENTS

| | | | | |
|---|---|---|---|---|
| 3,956,733 | A | 5/1976 | Sakurai | |
| 4,222,047 | A | 9/1980 | Finnegan | |
| 5,057,814 | A | 10/1991 | Onan et al. | |
| 6,441,730 | B1 | 8/2002 | Magruder | |
| 6,525,654 | B1 | 2/2003 | Siggers | |
| 7,042,165 | B2 | 5/2006 | Madhani et al. | |
| 7,262,559 | B2 | 8/2007 | Tripathi et al. | |
| 7,327,586 | B2 * | 2/2008 | Murakami et al. | 363/21.01 |
| 7,924,021 | B2 | 4/2011 | Joos et al. | |
| 8,018,170 | B2 * | 9/2011 | Chen et al. | 315/192 |
| 8,076,953 | B2 | 12/2011 | Snelten | |
| 2008/0204029 | A1 | 8/2008 | Mihai et al. | |
| 2010/0289518 | A1 | 11/2010 | Huang | |
| 2010/0289519 | A1 | 11/2010 | Huang | |
| 2012/0212133 | A1 | 8/2012 | Langkabel et al. | |

* cited by examiner

*Primary Examiner* — An Luu
(74) *Attorney, Agent, or Firm* — Woodard, Emhardt, Moriarty, McNett & Henry LLP

(57) ABSTRACT

A vehicle lighting outage detection circuit is disclosed having a plurality of parallel branches connected at a common positive reference node. Each parallel branch comprises a branch resistor and a current controlled branch switching device connected in series. A constant current source is connected to the positive reference node and configured to deliver a substantially constant current to the positive reference node. The cathode of a zener diode is connected to the positive reference node. When current to a predetermined number of the branch resistors is interrupted due to the failure one or more LEDs connected to the control inputs of the branch switching devices, the voltage at the positive reference node increases beyond the breakdown voltage of the zener diode. In such a condition, excess current flow to the anode of the zener diode to supply an outage detection signal.

28 Claims, 3 Drawing Sheets

220
244
260
IN
LM317
ADJUST
OUT
225
226
232
245
IN
OUT
LM217
ADJUST
242
243
252
236
238a
234a
238d
238c
238b
240d
240c
240b
240a
246a
234d
239d
239c
239b
239a
234b
246b
234c
246c
248
246d
224
222d
222a
222b
222c
230d
230a
230b
230c
259
258
226
255
261
250
257
263
256
262
228

VEHICLE LIGHTING OUTAGE DETECTION CIRCUIT

BACKGROUND

The present disclosure relates to lamps, and more specifically to lighting circuits used in vehicles.

Modern vehicle lamps, particular those mounted on the vehicle exterior which utilize light emitting diodes (LEDs) as the light source, are typically composed of multiple light emitting elements or LEDs in a single housing. It is important for the operator to be made aware if one or more LEDs in a lamp have failed, so that corrective measures can be taken to replace the faulty lamp or associated components. However, if a single or even multiple individual LEDs in a lamp malfunctions, the overall drop in current or voltage may not be enough to trigger traditional lamp failure warning circuitry and also may not be noticeable during visual inspection. Furthermore, if the LEDs are being driven by a constant current source, failure of one LED may cause excess current to be directed to the remaining LEDs, potentially causing damage or further failures.

One option for detecting LED failures in such vehicle lamps is to include microprocessors in the lamp housing or lighting circuit which have been programmed and connected to sense the current through the individual LEDs. However, this approach is often cost prohibitive due to the extensive software development and testing operations that are typically required. There are also some LED driver integrated circuits in the market which provide an outage detection feature, although these devices are typically confined to a single lighting arrangement with respect to the number of parallel LED branches that can be monitored or the number of failed LED branches that will trigger an outage indicator signal to be produced.

Thus, there is a need for improvement in this field.

SUMMARY

The invention is set forth by the claims and only the claims. Generally, it can be summarized as an outage detection circuit which provides outage detection for individual LED branches connected in parallel in a vehicle lamp. The outage detection circuit includes, but is not limited to, a plurality of parallel branches connected at a common positive reference node, with the parallel branches comprising a branch resistor and a branch switching device connected in series. A current source is connected to the positive reference node and configured to deliver a substantially constant current to the positive reference node. A zener diode or other voltage monitoring device is provided having a cathode connected to the positive reference node and an anode connected to an outage detection output node. The branch switching devices have a control input connected to a cathode of a corresponding one of the plurality of LEDs. The switching devices, which may optionally comprise transistors, are configured to interrupt current flow through a corresponding branch resistor when a corresponding LED fails open. When a predetermined number of LEDs fail open, the voltage at the positive reference node will rise above the breakdown voltage of the zener diode, thereby triggering the zener diode to supply current to the outage detection output node. This current may optionally be directed to other vehicle subsystems as an outage detection or indication signal. The current may also optionally be directed to an output switching device which will shunt current from the power supply to ground and blow a fuse associated with the lamp or lighting circuit, thereby disabling all of the LEDs in the lamp.

The invention solves the problem of providing outage detection for individual LEDs branches connected in parallel using a simple, cost effective and easily customizable design. Further forms, objects, features, aspects, benefits, advantages, and embodiments of the present invention will become apparent from the detailed description and drawings provided herewith.

DESCRIPTION OF THE SELECTED EMBODIMENTS

Figure 1:
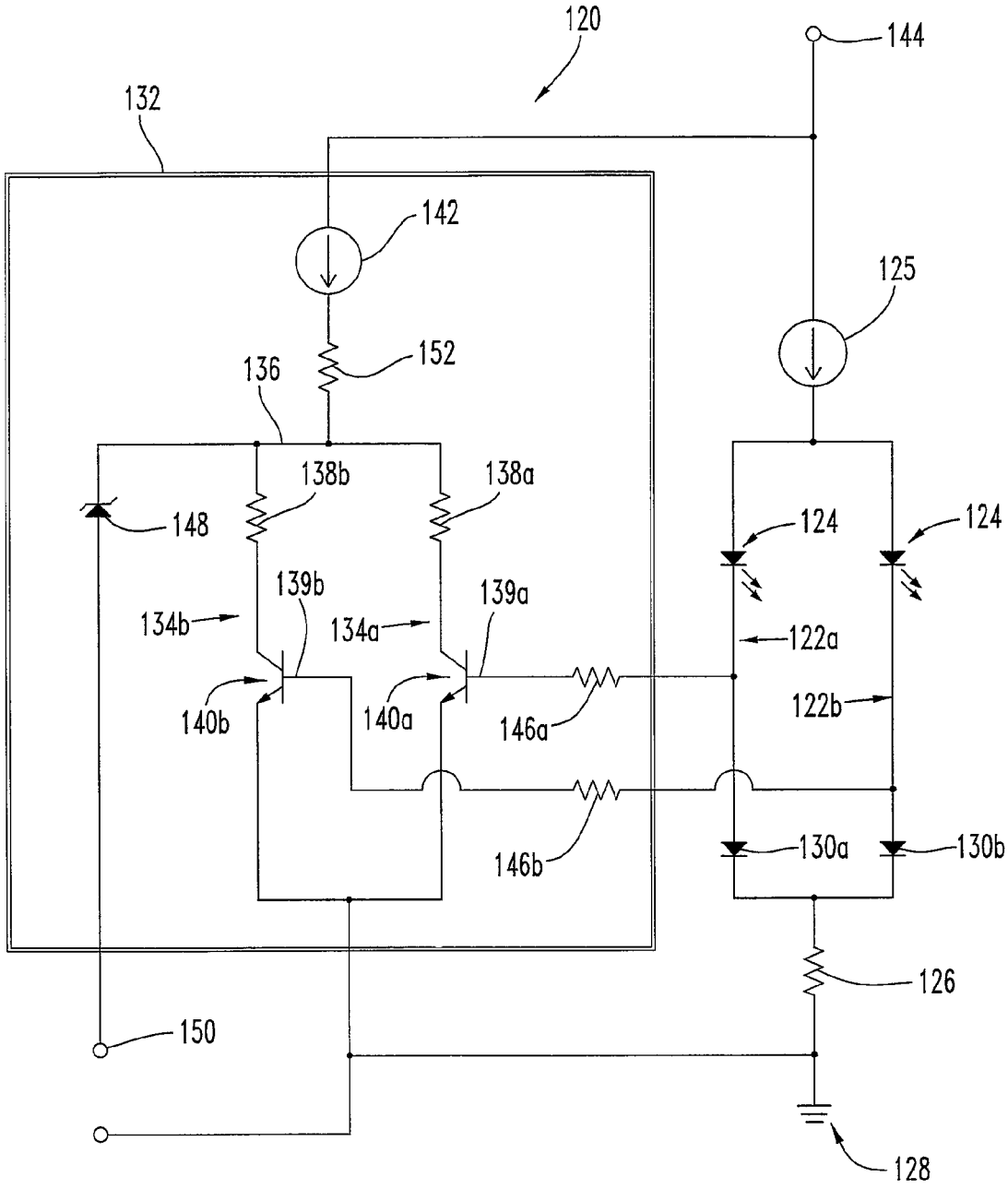
FIG. 1 is an electrical schematic diagram of a lighting circuit for a vehicle lamp according to one embodiment.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. Certain embodiments of the invention are shown in great detail, although it will be apparent to those skilled in the relevant art that some features that are not relevant to the present invention may not be shown for the sake of clarity.

Figure 2:
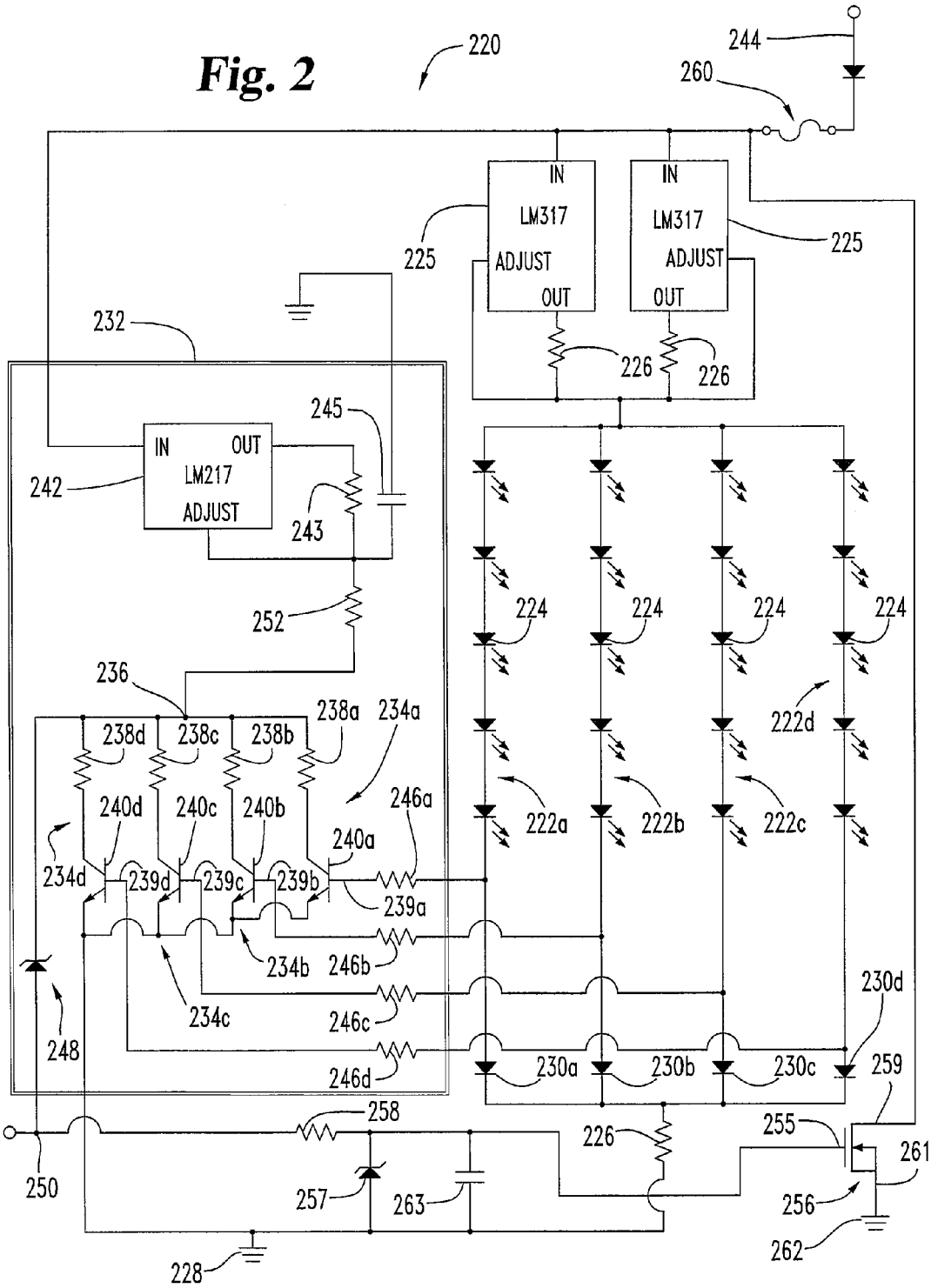
FIG. 2 is an electrical schematic diagram of a lighting circuit for a vehicle lamp according to one embodiment.
Figure 3:
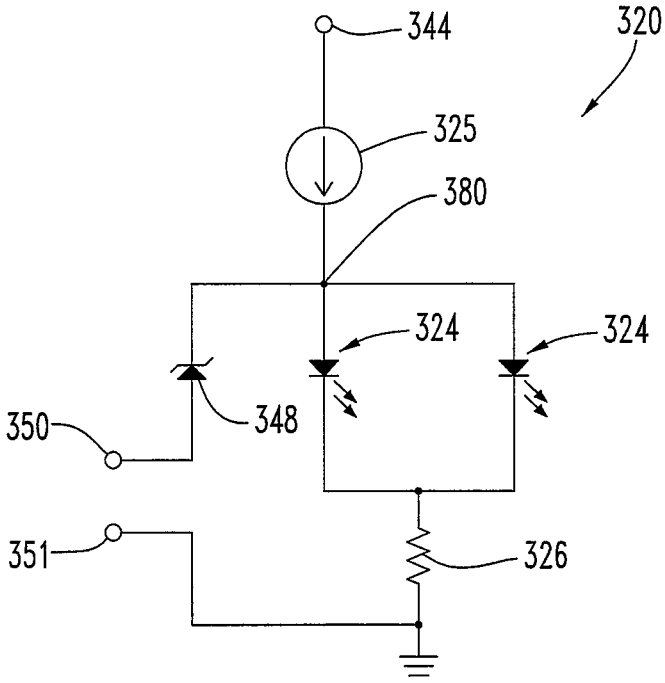
FIG. 3 is an electrical schematic diagram of a lighting circuit for a vehicle lamp according to one embodiment.

Referring to FIGS. 1-3, some examples of the invention are shown. Various examples are shown with similar reference figures, but with the hundred's digit prefix otherwise varied. Unless otherwise noted, components of such examples having the same reference characters in the ten's and one's digits are the same or similar.

Referring to FIG. 1, a vehicle lighting circuit 120 according to one embodiment of the disclosure is shown. The circuit 120 is fed from a vehicle lighting power supply (e.g., a stop, turn, or tail marker signal from the vehicle) at node 144 and includes a plurality of LED branches 122 connected in parallel as shown. In the embodiment of FIG. 1, two LED branches 122*a* and *b* are shown, however it shall be understood that any number of LED branches may be used. It shall be further understood that while each LED branch 122 in the embodiment of FIG. 1 is shown as having one individual LED 124, any number of LEDs may optionally be used in each branch 122. In certain embodiments, current source 125 is optionally connected to the LED branches 122 as shown to provide a controlled amount of current to safely energize the LEDs 124. Resistor 126 may be optionally connected between the LED branches 122 and ground 128 as shown. Blocking diodes 130*a* and *b* may also be optionally connected as shown between each LED branch 122 and ground 128 to prevent current from backfeeding through the LEDs 124.

In order to detect a failure condition of one or more of the LED branches 122, an outage detection circuit 132 is provided. In the embodiment of FIG. 1, the outage detection circuit 132 comprises two parallel detection branches 134*a* and *b* which correspond to the LED branches 122*a* and *b*, and which are connected at a common positive reference node 136. Each detection branch 134 optionally comprises a branch resistor 138 and a branch switching device, such as transistors 140, connected in series. In the illustrated embodiment, the branch switching devices are implemented as current controlled NPN bipolar junction transistors, although other types of switching devices may used.

A current source 142 is optionally connected between the main incoming voltage supply 144 (e.g., a stop, turn, or tail marker signal from the vehicle) and the positive reference node 136 to supply a substantially constant current into positive reference node 136 and through the parallel combination of detection branches 134. Resistor 152 may optionally be connected between the current source 142 and reference node 136.

The LED branches 122 are optionally connected to corresponding control inputs of the branch switching devices as shown. In the illustrated embodiment, the control inputs comprise the base 139 of the transistors 140. Resistors 146*a* and *b* are optionally connected between a base 139 and a node between the LEDs 124 and blocking diodes 130 as shown.

A voltage monitoring device, such as zener diode 148, is optionally connected as shown in a reverse bias fashion across the positive reference node 136 and a detection output node 150. In other words, the cathode of the zener diode 148 is connected to the positive reference node 136 and the anode of the zener diode 148 is connected to the detection output node 150. The zener diode 148 is configured to only conduct current when the voltage at the positive reference node 136 rises beyond a predetermined threshold (e.g., the specified breakdown voltage of the zener diode 148). It shall be understood that while a zener diode is used to monitor the voltage at the positive reference node 136 in the illustrated embodiment, other types of voltage monitoring devices may be used as well.

When power is supplied to the circuit from the vehicle via node 144 (typically 12 or 24 volts, although other voltages may be use) to illuminate the LEDs 124, the current source 125 provides current to the LED branches 122. If both of the LEDs 124 are operating properly, current will flow through the LED branches 122 and a portion of the current through each branch 122 will be directed to the base 139 of a corresponding transistor 140 via resistors 146, thereby turning on the corresponding transistor 140 (in saturation mode). The series combination of each diode 126 and the resistor 126 provide the required turn-on base-emitter voltage to the transistors 140. Because the emitters of the transistors 140 are connected to ground as shown, the collectors of the transistors 140 are also shorted to ground when the transistors are in saturation mode. Since the collectors of transistors 140 are shorted to ground, the resistors 138 are also grounded.

When both of the resistors 138 are grounded (i.e., both of the LED branches 122 are operational), the parallel combination of resistors 138*a* and *b*, collectively in series with the resistor 152, forms a voltage divider network. Therefore, the resistors 138*a*, 138*b*, and 152 and current source 142 can be chosen such that a specific voltage results at positive reference node 136 when both LEDs 124 are functioning properly. The zener diode 148 is specified to have a reference voltage (also referred to as the breakdown voltage) which is above the voltage at the reference node 136 when both LEDs 124 are functioning properly. Therefore, when both LEDs 124 are functioning, the zener diode 148 will not conduct any appreciable current to a detection load connected between the detection output node 150 and ground 128.

However, if one of the LEDs 124 fails open, there will be no current flow through the respective branch 122 and likewise no current will be directed to the base 139 of the corresponding transistor 140. Therefore, the transistor 140 corresponding to the failed LED branch 122 will turn off. This in turn breaks the ground path of the corresponding resistor 138 connected to the particular transistor 140. For example, in the embodiment of FIG. 1, if transistor 140*a* shuts off, current will only flow through resistor 138*b*. This causes the voltage at the positive reference node 136 to increase (as the current source 142 maintains a constant current into the node 136). If the reference voltage of the zener diode 148 is chosen to be less than the voltage at the reference node 136 when only one of the LEDs 124 is functioning (but more than the voltage when both LEDs are functioning), the zener diode 148 will begin conducting current to the detection output node 150. In other words, a voltage will begin to develop at the output detection node 150 which is approximately equal to the difference between the voltage at the reference node 136 and the reference voltage of the zener diode 148. This voltage can then be used to drive additional vehicle detection circuitry or trigger appropriate safety or protection measures. For example, the voltage at node 150 can be used to activate the vehicles turn or hazard blinkers, or to activate a lamp failure indicator in the driver instrument display. Additionally, as described further below, the voltage at node 150 can be used to drive another device which will shunt the lamp fuse to ground or otherwise trigger a shutdown of all of the LEDs 124.

Turning to FIG. 2, a vehicle lighting circuit 220 according to another embodiment is shown. The circuit 220 is similar to circuit 120, but involves four LED branches 222*a, b, c* and *d* connected in parallel as shown. Again, it shall be understood that any number of LED branches may be used. It shall be further understood that while each LED branch 222 in the embodiment of FIG. 2 is shown as having five individual LEDs 224 connected in series, any number of LEDs may be used in each branch 222. In the embodiment of FIG. 2, two current sources 225 are connected to the LED branches 222 as shown to provide the required amount of current to safely energize the LEDs 224. The current sources 225 shown in FIG. 2 comprise LM317 linear voltage regulators supplied by ST Microelectronics, with 12.4 ohm current setting resistors 126 connected across the "out" and "adjust" terminals as shown to deliver a constant 100 mA output current from each source 225. Also, in the embodiment of FIG. 2, the current source 242 is implemented an LM217 linear voltage regulator supplied by ST Microelectronics, with a 240 ohm current set resistor 243 connected across the "adjust" and "out" terminals as shown to deliver a 5 mA constant output current. The current sources 225 are optionally configured to collectively provide a total of 200 mA (each contributing 100 mA) to the parallel combination of the four LED branches 222. Resistors 246 are also optionally chosen to be 4.99 kilohms.

As described above, when all of the resistors 238 are grounded (i.e., all of the LED branches 222 are operational), the parallel combination of resistors 238 forms a resistor divider network. In the embodiment of FIG. 2, the current source 142 is configured to provide a constant current of approximately 5 mA through the resistor 152 (chosen to be 100 ohms) and into the positive reference node 136. The 5 mA output current of the current source 242 is produced because the LM217 regulator will maintain 1.25 volts across the 240 ohm resistor 243 which is connected between the "out" and "adjust" terminals of the LM217 source 242. The parallel combination of resistors 238*a,b,c* and *d* (chosen to each be 4.7 kilohms) results in an effective resistance of 1.175 kilohms. Therefore, the voltage at the positive reference node 236 is 5.875 volts. The zener diode is chosen to have a reference voltage (also referred to as the breakdown voltage) of 9.1 volts. Therefore, the outage detection is not triggered since the zener diode 248 will not conduct any appreciable current to the detection output node 150.

With continued reference to FIG. 2, when any one LED branch 222 fails open, current will only flow through three of the four resistors 238. This new parallel combination of three 4.7 ohm resistors will therefore result in a new effective resistance of 1.566 kilohms, and a higher voltage of 7.83 volts at the positive reference node 236 (as the current source 242 maintains a constant current of 5 mA into the node 236). Since this voltage is still below the 9.1 breakdown voltage of the zener diode 248, the zener diode will still not conduct current to the detection output node 250.

However, if two LED branches 222 fail open, only two of the resistors 238 will still be connected to ground. In this case, the effective resistance of the two remaining 4.7 kilohm resistors is now 2.35 kilohms. With the still constant current of 5 mA being supplied by the current source 142 to the positive reference node 236, the voltage at the positive reference node 236 increases to 11.75 volts, which is now higher than the breakdown voltage of the zener diode 248. The zener diode 248 will therefore begin conducting current to the detection output node 250. More specifically, 9.1 volts (the specified zener reference voltage) develops across the zener diode 248, and the remaining 2.65 volts develops across output detection node 250 and ground 228. This 2.65 volt output voltage can be used to drive further detection circuitry as discussed above.

As one example shown in the embodiment of FIG. 2, output detection node 250 may be connected to the control input of an additional switching device to effect further corrective measures, such as shutting down all of the LED branches 222. The additional switching device may optionally be implemented as a metal oxide semiconductor field effect transistor (MOSFET) 256, with the control input (gate 155) of the transistor 256 connected to the output detection node 250 via optional limiting resistor 258 (selected to be 24.9 kilohms). Zener diode 257 may also be optionally connected between the output detection node 250 and the gate of transistor 256 as shown to limit the voltage (9.1 volts in this example) at the gate of the transistor 256. The switched output terminals (drain 159 and source 161) of the transistor 256 are optionally connected just downstream of the circuit fuse 160 as shown, but upstream of the remaining circuit components. Therefore, when a voltage sufficient to turn on the transistor 256 develops at the output detection node 250, the transistor 256 will introduce a very low resistance path (drain to source) between the fuse 260 and ground 262. This shunts the full current from supply 244 to ground, causing the fuse to break, and disables power to the circuit 220. With the fuse broken and the entire lamp assembly disabled, the driver will be alerted to the outage condition more quickly either through visual inspection, or through other on-board vehicle warning systems which are configured to detect a full outage of the lamp assembly.

Capacitors 245 and 263 may be optionally connected as shown to provide an initial delay in the outage detection circuitry upon startup of the lamp and avoid false outage indication. More specifically, capacitor 245 will delay turn-on of the current supply 242, and thereby delaying any voltage from being generated at the output detection node 250. Likewise, capacitor 263 will delay current from reaching the gate 255 of the MOSFET 256, thereby delaying the fuse from breaking until the circuit has reached a steady state condition.

FIG. 3 shows a further embodiment, where the voltage monitoring device (e.g., zener diode 348) is connected in a reverse bias fashion to a node between a current source 325 which is supplying power to the LEDs 324 and the output detection node 350 as shown. In other words, the cathode of the zener diode 348 is connected to a reference node 380 which connects the anodes of the parallel LEDs 324, and the anode of the zener diode 348 is connected to the output detection node 350. If the reference voltage of the zener diode is chosen to be above the voltage at the reference node when both of the LEDs are functioning properly, but below the voltage at the reference node when one of the LEDs has failed open, then a voltage will develop at output detection node 350 when one one (or both) of the LEDs 324 fails open. As discussed above with respect to circuit 120 and 220, this voltage can be used to drive other vehicle outage detection circuitry or trigger other corrective measures.

As mentioned above, the above circuits can be configured to trigger the outage detection if any selected number of LED branches fail open. As one example, such adjustments can be made by changing the values used for resistors 238 and/or the specified breakdown voltage of the selected zener diode 248.

It shall be understood that the components of circuits 120, 220 or 320 may be included within a single housing, such as a vehicle lamp housing. Alternatively, certain components may be located in separate housings. As one non-limiting example, the components of the outage detection circuit 132, 232, or 332 may be located in a separate housing from the LEDs 124,224,324 and current sources 125,225,325. As another non-limiting example, the components of the outage detection circuit 132, 232, or 332 may be located in the same housing as the LEDs 124,224,324 and current sources 125, 225,325.

The term "anode" here means a terminal of a diode through which current enters the diode when the diode is forward biased.

The term "base" here means the control terminal of a bipolar junction transistor that controls the conductivity of the channel between the collector and emitter.

The term "branch" here means an electrical path through one or more electrical components which are connected in series.

The term "cathode" here means a terminal of a diode through which current leaves the diode when the diode is forward biased.

The term "collector" here means the terminal of a bipolar junction transistor into which a switched current enters when the transistor is forward biased.

The term "constant current source" here means an electrical device which is capable of supplying a substantially constant level of current through another electrical component or electrical path within a given circuit.

The term "control input" here means an input terminal of a device where the signal received at the terminal determines the functionality of the device. Some examples include the base of an NPN bipolar junction transistor and the gate of a MOSFET transistor.

The term "diode" here means a two terminal electrical device which allows current to flow in a one direction, but prevents current from flowing in the opposite direction. Examples include p-n silicon junction diodes, light emitting diodes, Schottky diodes, and Zener diodes, to name a few.

The term "drain" here means the terminal of a field effect transistor out of which a switched current leaves the transistor when the transistor is forward biased.

The term "emitter" here means the terminal of a bipolar junction transistor out of which a switched current leaves the transistor when the transistor is forward biased.

The term "fail open" here means to stop conducting current due to an internal component failure.

The term "fuse" here means a safety device a material that melts and breaks an electric circuit if the current through the material exceeds a specified safe level.

The term "gate" here means the control terminal of a field-effect transistor that controls the conductivity of the channel between the source and drain.

The term "LED" here means light emitting diode, including single diodes as well as arrays of LED's and/or grouped light emitting diodes. This can include the die and/or the LED film or other laminate, LED packages, said packages may include encapsulating material around a die, and the material, typically transparent, may or may not have color tinting and/or may or may not have a colored sub-cover. An LED can be a variety of colors, shapes, sizes and designs, including with or without heat sinking, lenses, or reflectors, built into the package.

The term "light" here means light which is visible to the naked human eye.

The term "node" here means an electrical junction between two or more electrical components, wherein the voltage at all physical points within the node is substantially equal.

The term "parallel" here means an electrical connection of two or more components where the voltage across the input and output terminals of the components is equal.

The term "resistor" here means a device having a resistance to the passage of electrical current.

The term "series" here means an electrical connection of two or more components where current passes through the first component and into the second component, and where the current passing through the two components is the same.

The term "source" here means The term "drain" here means the terminal of a field effect transistor into which a switched current enters the transistor when the transistor is forward biased.

The term "switching device" here means a device which is capable of dynamically allowing or interrupting current flow.

The term "vehicle" here means a self-propelled or towed device for transportation, including without limitation, car, truck, bus, boat, tank or other military vehicle, airplane, truck trailer, truck cab, boat trailer, other trailer, emergency vehicle, and motorcycle.

The term "voltage monitoring device" here means an electrical device which is capable of monitoring the voltage across and two electrical nodes. One example of such a device is a zener diode.

The term "zener diode" here means a diode which allow current to flow in a first direction, blocks current flow in the opposite direction up to a specified reference voltage, and allows current to flow in said opposite direction beyond said specified reference voltage.

Articles and phases such as, "the", "a", "an", "at least one", and "a first", are not limited to mean only one, but rather are inclusive and open ended to also include, optionally, two or more of such elements. In terms of the meaning of words herein, literally different elements or words in dependent claims are not superfluous, and have different meaning and are not to be imported or implied or synonymous with elements or words in the claims from which they depend.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Webster's dictionaries and Random House dictionaries.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A vehicle lighting outage detection circuit for a vehicle, comprising:

a plurality of parallel branches connected at a common positive reference node, a first one of said parallel branches comprising a first branch resistor and a first branch switching device connected in series, a second one of said parallel branches comprising a second branch resistor and a second branch switching device connected in series; and a voltage monitoring device connected to said positive reference node, said voltage monitoring device configured to detect voltage changes at the positive reference node;

wherein said first branch switching device is configured to interrupt current flow to said first branch resistor when a first LED has failed, and wherein said second branch switching device is configured to interrupt current flow to said second branch resistor when a second LED has failed.

2. The vehicle lighting outage detection circuit of claim 1, further comprising:

a current source connected to said positive reference node and configured to deliver a substantially constant current to said reference node.

3. The vehicle lighting outage detection circuit of claim 1, wherein the first branch switching device has a first control input, said first control input connected to a first cathode of the first LED, the first branch switching device configured to interrupt current flow through said first branch resistor when said first LED fails open;

wherein the second current controlled branch switching device has a second control input, said second control input connected to a second cathode of the second LED, the second branch switching device configured to interrupt current flow through said second branch resistor when the second LED fails open.

4. The vehicle lighting outage detection circuit of claim 3, wherein said first cathode of the first LED is connected to an anode of a first blocking diode; and wherein said second cathode of the second LED is connected to an anode of a second blocking diode.

5. The vehicle lighting outage detection circuit of claim 4, wherein a first anode of the first LED is connected to a second anode of the second LED.

6. The vehicle lighting outage detection circuit of claim 5, wherein the voltage monitoring device comprises a zener diode having a cathode connected to said positive reference node and an anode connected to an outage detection output node; and wherein the zener diode is configured to conduct current from the positive reference node to the outage detection output node if the voltage at the positive reference node increases above a predetermined threshold.

7. The vehicle lighting outage detection circuit of claim 6, wherein the resistance of the branch resistors is configured to maintain the voltage at the positive reference node below the predetermined threshold when all of the LEDs are functioning.

8. The vehicle lighting outage detection circuit of claim 7, wherein the resistance of the branch resistors is configured to maintain the voltage at the positive reference node above the predetermined threshold when a predetermined number of the LEDs fail open.

9. The vehicle lighting outage detection circuit of claim 8 wherein the branch switching devices comprise transistors.

10. The vehicle lighting outage detection circuit of claim 9, wherein the branch switching devices comprise NPN bipolar junction transistors; and wherein the control input comprises the base of the NPN bipolar junction transistors.

11. The vehicle lighting outage detection circuit of claim 10, wherein the collectors of the NPN bipolar junction transistors are connected to a corresponding branch resistor and the emitters of the NPN bipolar junction transistors are connected to ground.

12. The vehicle lighting outage detection circuit of claim 11, further comprising:

a plurality of input resistors, a first one of said input resistors connected between the cathode of the first one of said LEDs and the control input of the first branch switching device, a second one of said input resistors connected between the cathode of the second one of said LEDs and the control input of the second branch switching device.

13. The vehicle lighting outage detection circuit of claim 12, wherein the resistance of said input resistors is configured to turn on the corresponding branch switching device when the corresponding LED is operating properly and turn off the corresponding branch switching device when the corresponding LED fails open.

14. The vehicle lighting outage detection circuit of claim 13, further comprising:

an output switching device connected in series with a fuse, said LEDS also connected in series with said fuse;

wherein the outage detection output node is connected to a control input of the output switching device.

15. The vehicle lighting outage detection circuit of claim 14, wherein the output switching device is configured to shunt current from a vehicle power source to ground and break the fuse when a predetermined number of the LEDs fail open.

16. The vehicle lighting outage detection circuit of claim 1, wherein the voltage monitoring device comprises a zener diode having a cathode connected to said positive reference node and an anode connected to an outage detection output node; and wherein the zener diode is configured to conduct current from the positive reference node to the outage detection output node if the voltage at the positive reference node increases above a predetermined threshold.

17. The vehicle lighting outage detection circuit of claim 1, wherein the resistance of the branch resistors is configured to maintain the voltage at the positive reference node below the predetermined threshold when all of the LEDs are functioning.

18. The vehicle lighting outage detection circuit of claim 1, wherein the resistance of the branch resistors is configured to maintain the voltage at the positive reference node above the predetermined threshold when a predetermined number of the LEDs fail open.

19. The vehicle lighting outage detection circuit of claim 1 wherein the branch switching devices comprise transistors.

20. The vehicle lighting outage detection circuit of claim 1, further comprising:

a plurality of input resistors, a first one of said input resistors connected between the cathode of the first one of said LEDs and the control input of the first branch switching device, a second one of said input resistors connected between the cathode of the second one of said LEDs and the control input of the second branch switching device.

21. The vehicle lighting outage detection circuit of claim 20, wherein the resistance of said input resistors is configured to turn on the corresponding branch switching device when the corresponding LED is operating properly and turn off the corresponding branch switching device when the corresponding LED fails open.

22. The vehicle lighting outage detection circuit of claim 1, further comprising:

an output switching device connected with a fuse, said LEDS also connected in series with said fuse;

wherein the outage detection output node is connected to a control input of the output switching device.

23. A vehicle lighting outage detection circuit of claim 22, wherein the output switching device is configured to shunt current from a vehicle power source to ground and break the fuse when a predetermined number of the LEDs fail open.

24. A vehicle lighting outage detection circuit, comprising:

a plurality of LEDs, the anodes of said LEDs connected to a common positive reference node;

a constant current source connected to said positive reference node and configured to deliver a substantially constant current to said positive reference node; and a voltage monitoring device connected to said positive reference node, said voltage monitoring device configured to detect a voltage change at said reference node when at least one of said LEDs fails.

25. The vehicle lighting outage detection circuit of claim 24, wherein said voltage monitoring device is configured to detect voltage changes at said reference node when at least one of said LEDs fails open.

26. The vehicle lighting outage detection circuit of claim 25, wherein the voltage monitoring device comprises a zener diode having a cathode connected to said positive reference node and an anode connected to an outage detection output node; and wherein the zener diode is configured to conduct current from the positive reference node to the outage detection output node if the voltage at the positive reference node increases above a predetermined threshold.

27. The vehicle lighting outage detection circuit of claim 26, wherein the resistance of the LEDs is configured to maintain the voltage at the positive reference node below the predetermined threshold when all of the LEDs are functioning.

28. The vehicle lighting outage detection circuit of claim 27, wherein the resistance of the LEDs is configured to maintain the voltage at the positive reference node above the predetermined threshold when a predetermined number of the LEDs fail open.

* * * * *